US009704476B1

(12) United States Patent
Swietlinski et al.

(10) Patent No.: US 9,704,476 B1
(45) Date of Patent: Jul. 11, 2017

(54) ADJUSTABLE TTS DEVICES

(71) Applicant: Amazon Technologies, Inc., Reno, NV (US)

(72) Inventors: Krzysztof Franciszek Swietlinski, Sopot (PL); Michal Tadeusz Kaszczuk, Gdansk (PL)

(73) Assignee: AMAZON TECHNOLOGIES, INC., Seattle, WA (US)

( * ) Notice: Subject to any disclaimer, the term of this patent is extended or adjusted under 35 U.S.C. 154(b) by 751 days.

(21) Appl. No.: 13/929,104

(22) Filed: Jun. 27, 2013

(51) Int. Cl.
*G10L 13/08* (2013.01)
*G10L 13/00* (2006.01)

(52) U.S. Cl.
CPC ..... *G10L 13/00* (2013.01)

(58) Field of Classification Search
CPC ..... G10L 13/00
USPC ..... 704/260
See application file for complete search history.

(56) References Cited

U.S. PATENT DOCUMENTS 6,128,642 A * 10/2000 Doraswamy ..... G06F 9/505 709/201
6,188,983 B1 * 2/2001 Hanson ..... G10L 13/033 704/260
6,539,445 B1 * 3/2003 Krum ..... G06F 13/00 709/208
6,757,362 B1 * 6/2004 Cooper ..... H04M 3/527 379/88.01
7,263,177 B1 * 8/2007 Paterik ..... H04M 3/493 370/353
2001/0032083 A1 * 10/2001 Van Cleven ..... G10L 15/30 704/270.1
2006/0149558 A1 * 7/2006 Kahn ..... G10L 15/063 704/278
2010/0057465 A1 * 3/2010 Kirsch ..... G10L 13/033 704/260
2010/0142516 A1 * 6/2010 Lawson ..... H04M 7/0021 370/352
2010/0232594 A1 * 9/2010 Lawson ..... G06F 9/505 379/220.01
2012/0078609 A1 * 3/2012 Chaturvedi ..... G06F 17/28 704/3
2012/0330667 A1 * 12/2012 Sun ..... G10L 13/08 704/260
2014/0200894 A1 * 7/2014 Osowski ..... G10L 13/08 704/260

* cited by examiner

*Primary Examiner* — Jakieda Jackson
(74) *Attorney, Agent, or Firm* — Pierce Atwood LLP

(57) ABSTRACT

In a distributed text-to-speech (TTS) system, a remote TTS device, such as a TTS server, may experience increased loads of TTS requests, which may result in delayed processing of TTS requests. To avoid such delays, upon indication or prediction of an increased load, a TTS server may adjust unit selection TTS processing by altering unit selection techniques to speed processing, at the expense of potential result quality. Such techniques may include use of a reduced size unit database, a narrow Viterbi beam search, and/or a reduced size candidate unit graph.

20 Claims, 8 Drawing Sheets

ADJUSTABLE TTS DEVICES

BACKGROUND

Human-computer interactions have progressed to the point where computing devices can render spoken language output to users based on textual sources available to the devices. In such text-to-speech (TTS) systems, a device converts text into an acoustic waveform that is recognizable as speech corresponding to the input text. TTS systems may provide spoken output to users in a number of applications, enabling a user to receive information from a device without necessarily having to rely on tradition visual output devices, such as a monitor or screen. A TTS process may be referred to as speech synthesis or speech generation.

Speech synthesis may be used by computers, hand-held devices, telephone computer systems, kiosks, automobiles, and a wide variety of other devices to improve human-computer interactions.

BRIEF DESCRIPTION OF DRAWINGS

For a more complete understanding of the present disclosure, reference is now made to the following description taken in conjunction with the accompanying drawings.

DETAILED DESCRIPTION

Text-to-speech (TTS) processing may involve a distributed system where a user inputs a TTS request into a local device that then sends portions of the request to a remote device, such as a server, for further TTS processing. The remote device may then process the request and return results to the user's local device to be accessed by the user.

During times when a particular TTS server may receive a large number of requests, certain users may experience delays in the processing of their requests as the TTS server makes its way through the backlog of requests. Such user delays may be undesirable for a number of reasons, including user dissatisfaction. Offered is a system and method for providing adjustable TTS servers which may be configured to adjust their processing capabilities in view of high server load, such as a large number of TTS requests or TTS requests that are large in size or particularly costly to process. When faced with a predicted or existing high load, the adjustable TTS servers (or other TTS processing devices) may be configured to reduce the quality of TTS processing. By reducing the quality of TTS processing, a TTS server may dedicate fewer processing resources (such as CPU time, etc.) to each individual request, thereby allowing the TTS server to process more TTS requests in a shorter period of time and increasing the overall capacity of the system. As described in more detail below, TTS quality may be reduced by using smaller unit databases, dynamically reducing the size of a unit database, adjusting a search for unit selection, reducing a number of candidate units and/or other techniques.

Figure 1:
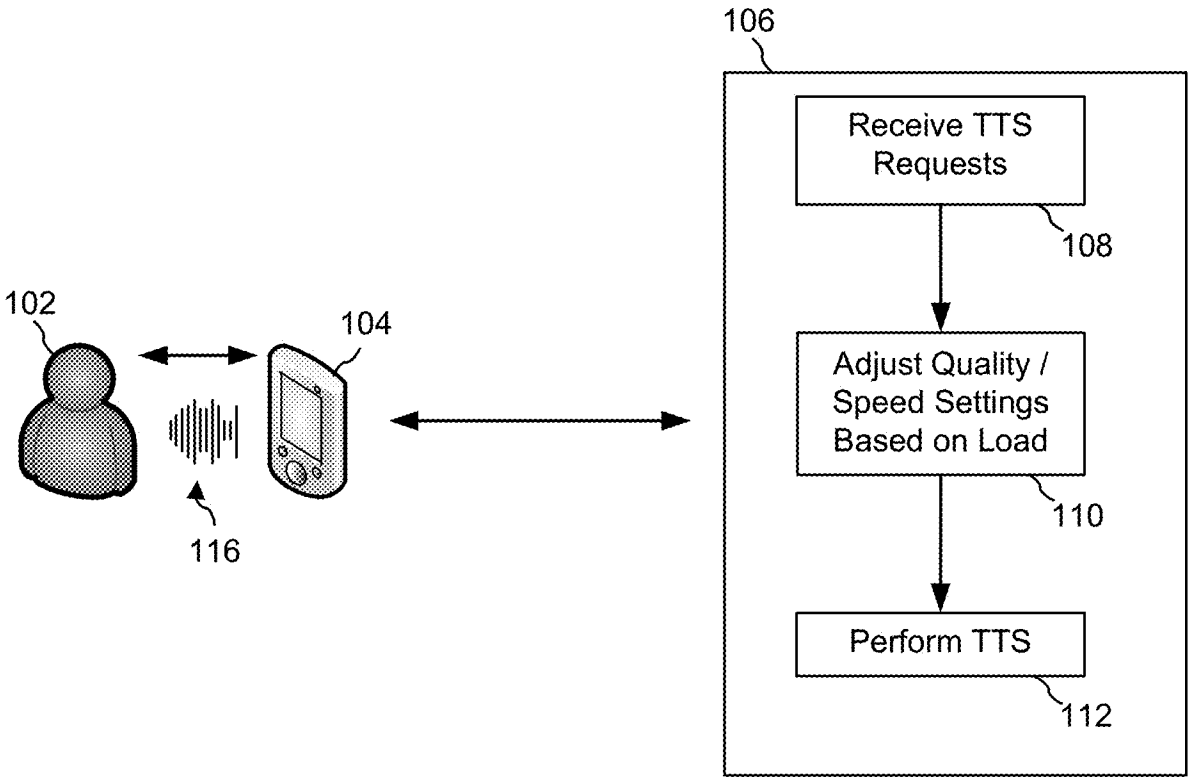
FIG. 1 illustrates adjustable text-to-speech (TTS) servers according to one aspect of the present disclosure.

As shown in FIG. 1, a user 102 enters a TTS request through a local device 104. The local device 104 sends the TTS request to a remote device 106, such as a TTS server. The remote device 106 receives TTS requests 108. The remote device 106 checks its TTS processing load 110 to determine if its load is higher than a threshold. If the remote device 106 has a low load it processes the TTS request 112. If the remote device 106 has a high load, it adjusts its quality/speed settings to enable the remote device 106 to process TTS requests faster. It then continues processing TTS requests 112. The user's TTS request is processed by the remote device 106 and returned to the local device 104 which outputs the desired speech 116 to the user 102. If the remote device 106 adjusted to a high load operating mode, the resulting speech 116 may be of lower quality than speech resulting from a normally processed TTS request. A more detailed explanation of a TTS system, along with further details of adjustable TTS processing devices, follows below.

Figure 2:
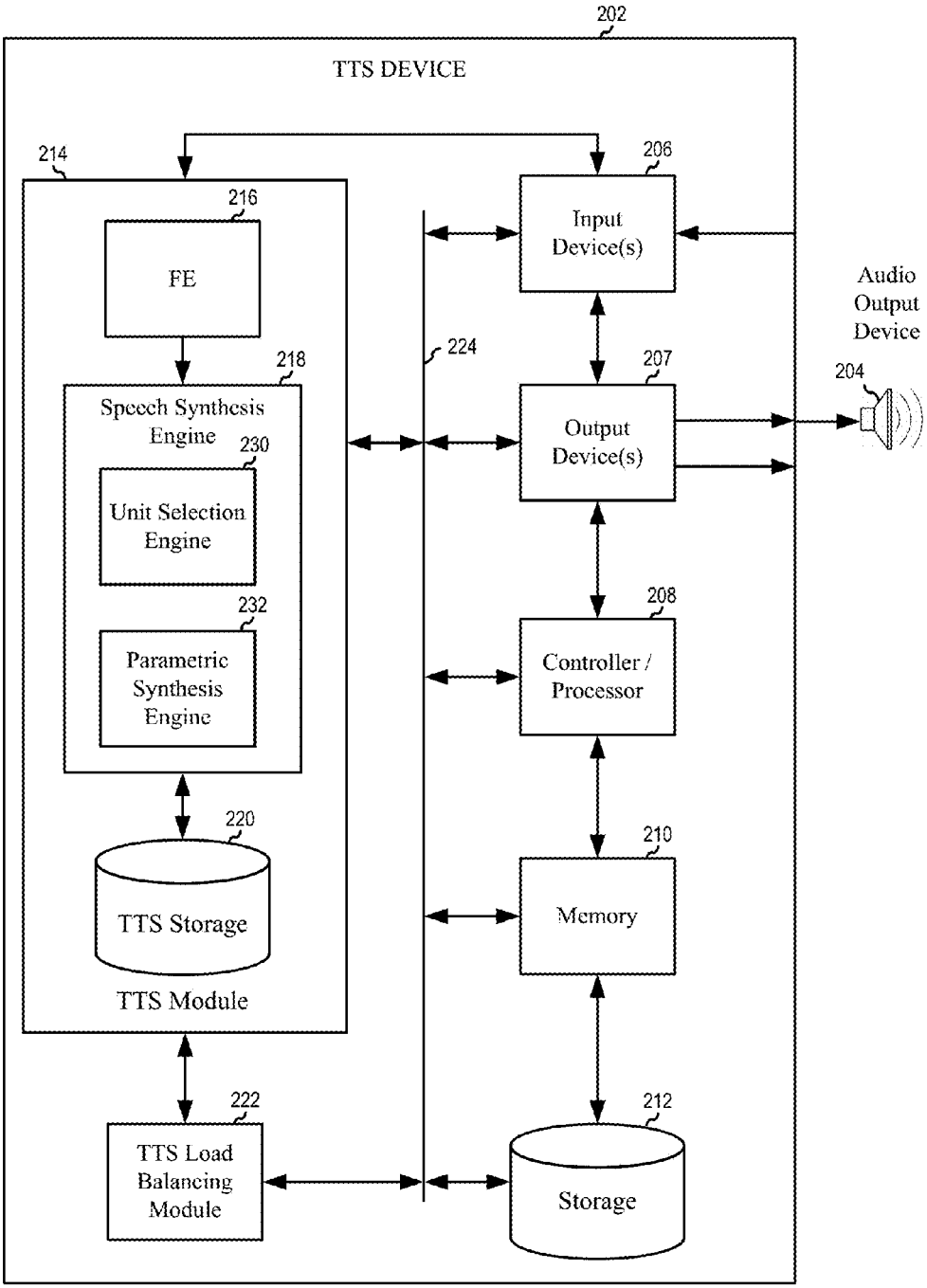
FIG. 2 is a block diagram conceptually illustrating a device for text-to-speech processing according to one aspect of the present disclosure.

FIG. 2 shows a text-to-speech (TTS) device 202 for performing speech synthesis. Aspects of the present disclosure include computer-readable and computer-executable instructions that may reside on the TTS device 202. FIG. 2 illustrates a number of components that may be included in the TTS device 202, however other non-illustrated components may also be included. Also, some of the illustrated components may not be present in every device capable of employing aspects of the present disclosure. Further, some components that are illustrated in the TTS device 202 as a single component may also appear multiple times in a single device. For example, the TTS device 202 may include multiple input devices 206, output devices 207 or multiple controllers/processors 208.

Multiple TTS devices may be employed in a single speech synthesis system. In such a multi-device system, the TTS devices may include different components for performing different aspects of the speech synthesis process. The multiple devices may include overlapping components. The TTS device as illustrated in FIG. 2 is exemplary, and may be a stand-alone device or may be included, in whole or in part, as a component of a larger device or system.

The teachings of the present disclosure may be applied within a number of different devices and computer systems, including, for example, general-purpose computing systems, server-client computing systems, mainframe computing systems, telephone computing systems, laptop computers, cellular phones, personal digital assistants (PDAs), tablet computers, other mobile devices, etc. The TTS device 202 may also be a component of other devices or systems that may provide speech recognition functionality such as automated teller machines (ATMs), kiosks, global position systems (GPS), home appliances (such as refrigerators, ovens, etc.), vehicles (such as cars, busses, motorcycles, etc.), and/or ebook readers, for example.

As illustrated in FIG. 2, the TTS device 202 may include an audio output device 204 for outputting speech processed by the TTS device 202 or by another device. The audio output device 204 may include a speaker, headphone, or other suitable component for emitting sound. The audio output device 204 may be integrated into the TTS device 202 or may be separate from the TTS device 202. The TTS device 202 may also include an address/data bus 224 for conveying data among components of the TTS device 202. Each component within the TTS device 202 may also be directly connected to other components in addition to (or instead of) being connected to other components across the bus 224. Although certain components are illustrated in FIG. 2 as directly connected, these connections are illustrative only and other components may be directly connected to each other (such as the TTS module 214 to the controller/processor 208).

The TTS device 202 may include a controller/processor 208 that may be a central processing unit (CPU) for processing data and computer-readable instructions and a memory 210 for storing data and instructions. The memory 210 may include volatile random access memory (RAM), non-volatile read only memory (ROM), and/or other types of memory. The TTS device 202 may also include a data storage component 212, for storing data and instructions. The data storage component 212 may include one or more storage types such as magnetic storage, optical storage, solid-state storage, etc. The TTS device 202 may also be connected to removable or external memory and/or storage (such as a removable memory card, memory key drive, networked storage, etc.) through the input device 206 or output device 207. Computer instructions for processing by the controller/processor 208 for operating the TTS device 202 and its various components may be executed by the controller/processor 208 and stored in the memory 210, storage 212, external device, or in memory/storage included in the TTS module 214 discussed below. Alternatively, some or all of the executable instructions may be embedded in hardware or firmware in addition to or instead of software. The teachings of this disclosure may be implemented in various combinations of software, firmware, and/or hardware, for example.

The TTS device 202 includes input device(s) 206 and output device(s) 207. A variety of input/output device(s) may be included in the device. Example input devices include an audio input device, such as a microphone, a touch input device, keyboard, mouse, stylus or other input device. Example output devices include a visual display, tactile display, audio speakers (pictured as a separate component), headphones, printer or other output device. The input device 206 and/or output device 207 may also include an interface for an external peripheral device connection such as universal serial bus (USB), FireWire, Thunderbolt or other connection protocol. The input device 206 and/or output device 207 may also include a network connection such as an Ethernet port, modem, etc. The input device 206 and/or output device 207 may also include a wireless communication device, such as radio frequency (RF), infrared, Bluetooth, wireless local area network (WLAN) (such as WiFi), or wireless network radio, such as a radio capable of communication with a wireless communication network such as a Long Term Evolution (LTE) network, WiMAX network, 3G network, etc. Through the input device 206 and/or output device 207 the TTS device 202 may connect to a network, such as the Internet or private network, which may include a distributed computing environment.

The device may also include a TTS module 214 for processing textual data into audio waveforms including speech. The TTS module 214 may be connected to the bus 224, input device(s) 206, output device(s) 207 audio output device 204, controller/processor 208 and/or other component of the TTS device 202. The textual data may originate from an internal component of the TTS device 202 or may be received by the TTS device 202 from an input device such as a keyboard or may be sent to the TTS device 202 over a network connection. The text may be in the form of sentences including text, numbers, and/or punctuation for conversion by the TTS module 214 into speech. The input text may also include special annotations for processing by the TTS module 214 to indicate how particular text is to be pronounced when spoken aloud or to specify metadata about a particular input for various purposes such as troubleshooting, post-processing, data classification, etc. Textual data may be processed in real time or may be saved and processed at a later time.

The TTS module 214 includes a TTS front end (FE) 216, a speech synthesis engine 218, and TTS storage 220. The FE 216 transforms input text data into a symbolic linguistic representation for processing by the speech synthesis engine 218. The speech synthesis engine 218 compares the annotated phonetic units models and information stored in the TTS storage 220 for converting the input text into speech. The FE 216 and speech synthesis engine 218 may include their own controller(s)/processor(s) and memory or they may use the controller/processor 208 and memory 210 of the TTS device 202, for example. Similarly, the instructions for operating the FE 216 and speech synthesis engine 218 may be located within the TTS module 214, within the memory 210 and/or storage 212 of the TTS device 202, or within an external device.

Text input into a TTS module 214 may be sent to the FE 216 for processing. The front-end may include modules for performing text normalization, linguistic analysis, and linguistic prosody generation. During text normalization, the FE processes the text input and generates standard text, converting such things as numbers, abbreviations (such as Apt., St., etc.), symbols ($, %, etc.), irregular proper names (Ke$ha, Se7en, 3oh!3, etc.) into the equivalent of written out words.

During linguistic analysis the FE 216 analyzes the language in the normalized text to generate a sequence of phonetic units corresponding to the input text. This process may be referred to as phonetic transcription. Phonetic units include symbolic representations of sound units to be eventually combined and output by the TTS device 202 as speech. Various sound units may be used for dividing text for purposes of speech synthesis. A TTS module 214 may process speech based on phonemes (individual sounds), half-phonemes, di-phones (the last half of one phoneme coupled with the first half of the adjacent phoneme), bi-phones (two consecutive phonemes), syllables, words, parts-of-speech (i.e., noun, verb, etc.), phrases, sentences, or other units. Each component of the written language units, such as graphemes, may be mapped to a component of grammatical language units, such as morphemes, which are in turn associated with spoken language units, such as the phonetic units discussed above. Each word of text may be mapped to zero, one or more phonetic units. Such mapping may be performed using a language dictionary stored in the TTS device 202, for example in the TTS storage module 220. The linguistic analysis performed by the FE 216 may also identify different grammatical components such as prefixes, suffixes, phrases, punctuation, syntactic boundaries, or the like. Such grammatical components may be used by the TTS module 214 to craft a natural sounding audio waveform output. The language dictionary may also include letter-to-sound rules and other tools that may be used to pronounce previously unidentified words or letter combinations that may be encountered by the TTS module 214. Generally, the more information included in the language dictionary, the higher quality the speech output.

Based on the linguistic analysis the FE 216 may then perform linguistic prosody generation where the phonetic units are annotated with desired prosodic characteristics, also called acoustic features, which indicate how the desired phonetic units are to be pronounced in the eventual output speech. During this stage the FE 216 may consider and incorporate any prosodic annotations that accompanied the text input to the TTS module 214. Such acoustic features may include pitch, energy, duration, and the like. Application of acoustic features may be based on prosodic models available to the TTS module 214. Such prosodic models indicate how specific phonetic units are to be pronounced in certain circumstances. A prosodic model may consider, for example, a phoneme's position in a syllable, a syllable's position in a word, a word's position in a sentence or phrase, neighboring phonetic units, etc. As with the language dictionary, prosodic model with more information may result in higher quality speech output than prosodic models with less information.

The output of the FE 216, referred to as a symbolic linguistic representation, may include a sequence of phonetic units annotated with prosodic characteristics. This symbolic linguistic representation may be sent to a speech synthesis engine 218, also known as a synthesizer, for conversion into an audio waveform of speech for output to an audio output device 204 and eventually to a user. The speech synthesis engine 218 may be configured to convert the input text into high-quality natural-sounding speech in an efficient manner. Such high-quality speech may be configured to sound as much like a human speaker as possible, or may be configured to be understandable to a listener without attempts to mimic a precise human voice.

A speech synthesis engine 218 may perform speech synthesis using one or more different methods. In one method of synthesis called unit selection, described further below, a unit selection engine 230 matches a database of recorded speech against the symbolic linguistic representation created by the FE 216. The unit selection engine 230 matches the symbolic linguistic representation against spoken audio units in the database. Matching units are selected and concatenated together to form a speech output. Each unit includes an audio waveform corresponding with a phonetic unit, such as a short .wav file of the specific sound, along with a description of the various acoustic features associated with the .wav file (such as its pitch, energy, etc.), as well as other information, such as where the phonetic unit appears in a word, sentence, or phrase, the neighboring phonetic units, etc. Using all the information in the unit database, a unit selection engine 230 may match units to the input text to create a natural sounding waveform. The unit database may include multiple examples of phonetic units to provide the TTS device 202 with many different options for concatenating units into speech. One benefit of unit selection is that, depending on the size of the database, a natural sounding speech output may be generated. The larger the unit database, the more likely the TTS device 202 will be able to construct natural sounding speech.

In another method of synthesis called parametric synthesis parameters such as frequency, volume, noise, are varied by a parametric synthesis engine 232, digital signal processor or other audio generation device to create an artificial speech waveform output. Parametric synthesis may use an acoustic model and various statistical techniques to match a symbolic linguistic representation with desired output speech parameters. Parametric synthesis may include the ability to be accurate at high processing speeds, as well as the ability to process speech without large databases associated with unit selection, but also typically produces an output speech quality that may not match that of unit selection. Unit selection and parametric techniques may be performed individually or combined together and/or combined with other synthesis techniques to produce speech audio output.

Parametric speech synthesis may be performed as follows. A TTS module 214 may include an acoustic model, or other models, which may convert a symbolic linguistic representation into a synthetic acoustic waveform of the text input based on audio signal manipulation. The acoustic model includes rules which may be used by the parametric synthesis engine 232 to assign specific audio waveform parameters to input phonetic units and/or prosodic annotations. The rules may be used to calculate a score representing a likelihood that a particular audio output parameter(s) (such as frequency, volume, etc.) corresponds to the portion of the input symbolic linguistic representation from the FE 216.

The parametric synthesis engine 232 may use a number of techniques to match speech to be synthesized with input phonetic units and/or prosodic annotations. One common technique is using Hidden Markov Models (HMMs). HMMs may be used to determine probabilities that audio output should match textual input. HMMs may be used to translate from parameters from the linguistic and acoustic space to the parameters to be used by a vocoder (a digital voice encoder) to artificially synthesize the desired speech. Using HMMs, a number of states are presented, in which the states together represent one or more potential acoustic parameters to be output to the vocoder and each state is associated with a model, such as a Gaussian mixture model. Transitions between states may also have an associated probability, representing a likelihood that a current state may be reached from a previous state. Sounds to be output may be represented as paths between states of the HMM and multiple paths may represent multiple possible audio matches for the same input text. Each portion of text may be represented by multiple potential states corresponding to different known pronunciations of phonemes and their parts (such as the phoneme identity, stress, accent, position, etc.). An initial determination of a probability of a potential phoneme may be associated with one state. As new text is processed by the speech synthesis engine 218, the state may change or stay the same, based on the processing of the new text. For example, the pronunciation of a previously processed word might change based on later processed words. A Viterbi algorithm may be used to find the most likely sequence of states based on the processed text. The HMMs may generate speech in parameterized form including parameters such as fundamental frequency (f0), noise envelope, spectral envelope, etc. that are translated by a vocoder into audio segments. The output parameters may be configured for particular vocoders such as a STRAIGHT vocoder, HNM (harmonic plus noise) based vocoders, CELP (code-excited linear prediction) vocoders, GlottHMM vocoders, HSM (harmonic/stochastic model) vocoders, or others.

Figure 3:
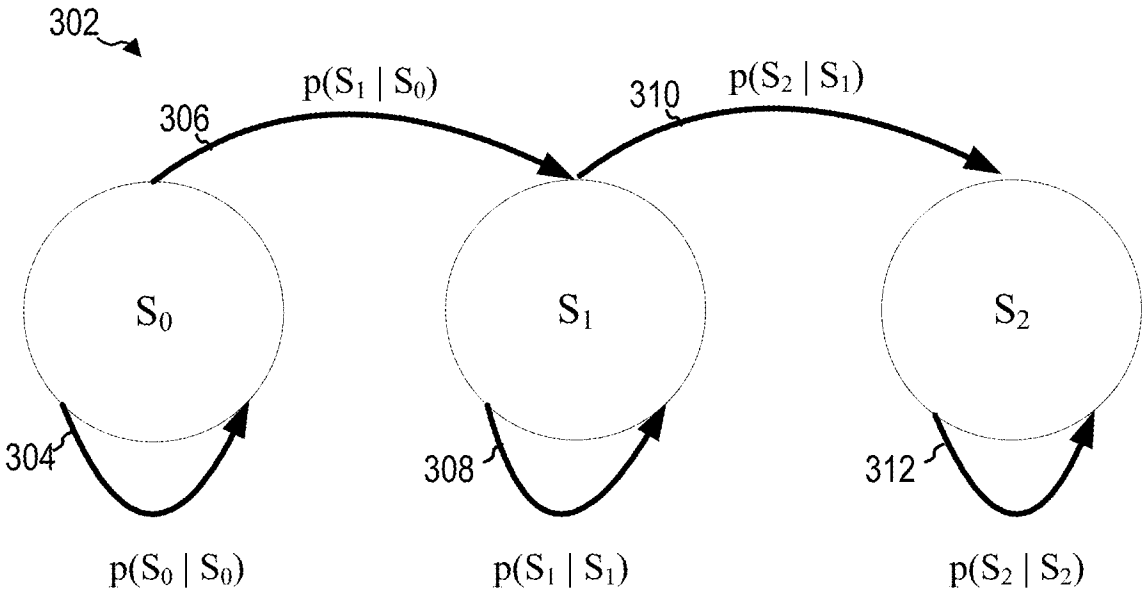
FIG. 3 illustrates speech synthesis using a Hidden Markov Model according to one aspect of the present disclosure.

An example of HMM processing for speech synthesis is shown in FIG. 3. A sample input phonetic unit, for example, phoneme /E/, may be processed by a parametric synthesis engine 232. The parametric synthesis engine 232 may initially assign a probability that the proper audio output associated with that phoneme is represented by state $S_0$ in the Hidden Markov Model illustrated in FIG. 3. After further processing, the speech synthesis engine 218 determines whether the state should either remain the same, or change to a new state. For example, whether the state should remain the same 304 may depend on the corresponding transition probability (written as $P(S_0|S_0)$, meaning the probability of going from state $S_0$ to $S_0$) and how well the subsequent frame matches states $S_0$ and $S_1$. If state $S_1$ is the most probable, the calculations move to state $S_1$ and continue from there. For subsequent phonetic units, the speech synthesis engine 218 similarly determines whether the state should remain at $S_1$, using the transition probability represented by $P(S_1|S_1)$ 308, or move to the next state, using the transition probability $P(S_2|S_1)$ 310. As the processing continues, the parametric synthesis engine 232 continues calculating such probabilities including the probability 312 of remaining in state $S_2$ or the probability of moving from a state of illustrated phoneme /E/ to a state of another phoneme. After processing the phonetic units and acoustic features for state $S_2$, the speech recognition may move to the next phonetic unit in the input text.

The probabilities and states may be calculated using a number of techniques. For example, probabilities for each state may be calculated using a Gaussian model, Gaussian mixture model, or other technique based on the feature vectors and the contents of the TTS storage 220. Techniques such as maximum likelihood estimation (MLE) may be used to estimate the probability of particular states.

In addition to calculating potential states for one audio waveform as a potential match to a phonetic unit, the parametric synthesis engine 232 may also calculate potential states for other potential audio outputs (such as various ways of pronouncing phoneme /E/) as potential acoustic matches for the phonetic unit. In this manner multiple states and state transition probabilities may be calculated.

The probable states and probable state transitions calculated by the parametric synthesis engine 232 may lead to a number of potential audio output sequences. Based on the acoustic model and other potential models, the potential audio output sequences may be scored according to a confidence level of the parametric synthesis engine 232. The highest scoring audio output sequence, including a stream of parameters to be synthesized, may be chosen and digital signal processing may be performed by a vocoder or similar component to create an audio output including synthesized speech waveforms corresponding to the parameters of the highest scoring audio output sequence and, if the proper sequence was selected, also corresponding to the input text.

Unit selection speech synthesis may be performed as follows. Unit selection includes a two-step process. A unit selection engine 230 first determines what speech units to use and then combines them so that the particular combined units match the desired phonemes and acoustic features and create the desired speech output. Units may be selected based on a cost function which represents how well particular units fit the speech segments to be synthesized. The cost function may represent a combination of different costs representing different aspects of how well a particular speech unit may perceptually match a particular speech segment. For example, a target cost indicates how well a given speech unit matches the linguistic features of a desired speech output (such as pitch, prosody, accents, stress, syllable position, word position, etc.). A join cost represents how well a speech unit matches a consecutive speech unit for purposes of concatenating the speech units together in the eventual synthesized speech. A unit's fundamental frequency (f0), spectrum, energy, and other factors, as compared to those factors of a potential neighboring unit may all affect the join cost between the units. The overall cost function is a combination of target cost, join cost, and other costs that may be determined by the unit selection engine 230. As part of unit selection, the unit selection engine 230 chooses the speech unit with the lowest overall combined cost. For example, a speech unit with a very low target cost may not necessarily be selected if its join cost is high.

A TTS device 202 may be configured with a speech unit database for use in unit selection. The speech unit database may be stored in TTS storage 220, in storage 212, or in another storage component. The speech unit database includes recorded speech utterances with the utterances' corresponding text aligned to the utterances. The speech unit database may include many hours of recorded speech (in the form of audio waveforms, feature vectors, or other formats), which may occupy a significant amount of storage in the TTS device 202. The unit samples in the speech unit database may be classified in a variety of ways including by phonetic unit (phoneme, diphone, word, etc.), linguistic prosodic label, acoustic feature sequence, speaker identity, etc. The sample utterances may be used to create mathematical models corresponding to desired audio output for particular speech units. When matching a symbolic linguistic representation the speech synthesis engine 218 may attempt to select a unit in the speech unit database that most closely matches the input text (including both phonetic units and prosodic annotations). Generally the larger the speech unit database the better the speech synthesis may be achieved by virtue of the greater number of unit samples that may be selected to form the precise desired speech output.

Figure 4A:
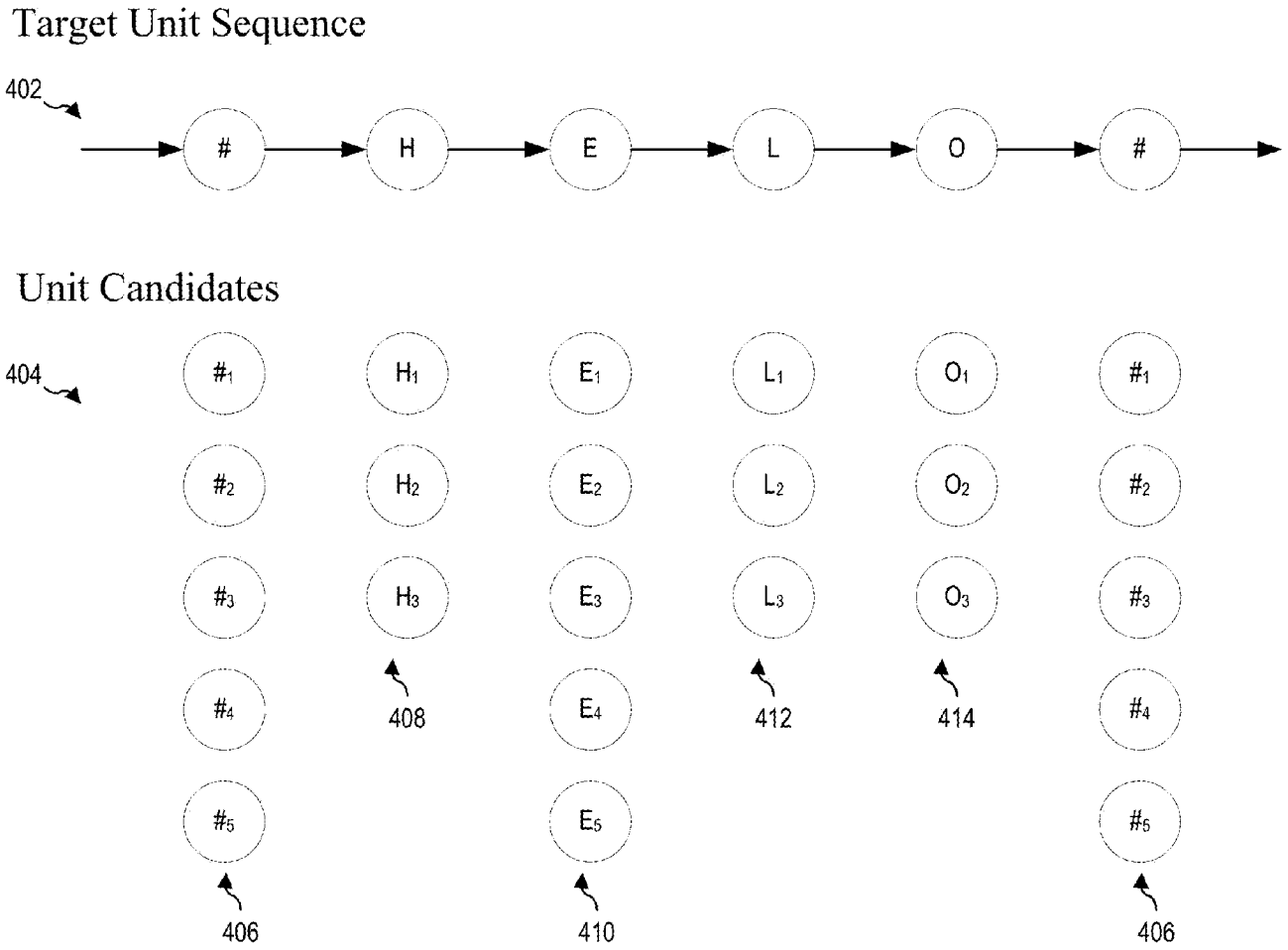
FIGS. 4A-4B illustrate speech synthesis using unit selection according to one aspect of the present disclosure.
Figure 4B:
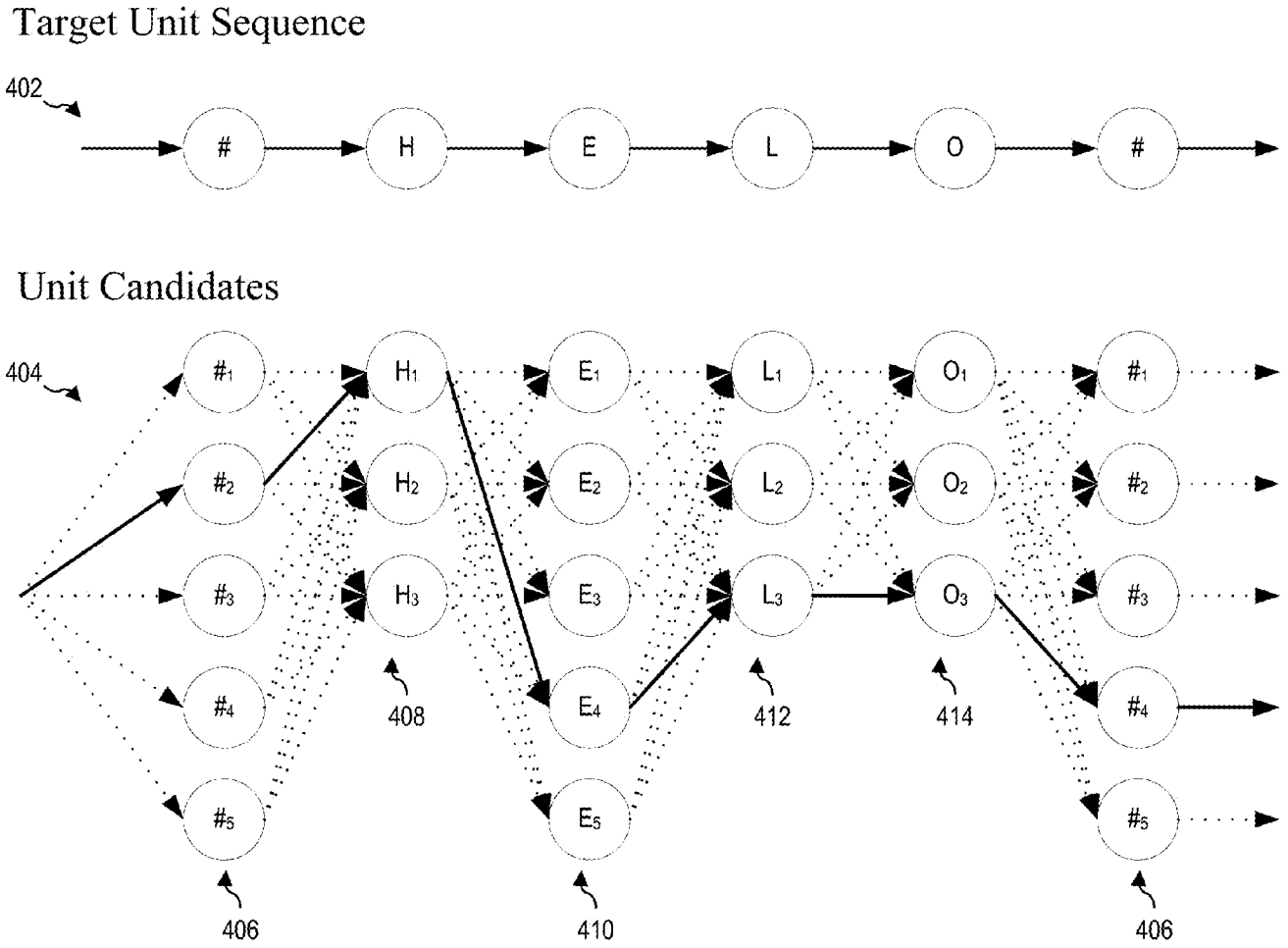

For example, as shown in FIG. 4A, a target sequence of phonetic units 402 to synthesize the word "hello" is determined by the unit selection engine 230. A number of candidate units 404 may be stored in the TTS storage 220. Although phonemes are illustrated in FIG. 4A, other phonetic units, such as diphones, may be selected and used for unit selection speech synthesis. For each phonetic unit there are a number of potential candidate units (represented by columns 406, 408, 410, 412 and 414) available. Each candidate unit represents a particular recording of the phonetic unit with a particular associated set of acoustic features. The unit selection engine 230 then creates a graph of potential sequences of candidate units to synthesize the available speech. The size of this graph may be variable based on certain device settings. An example of this graph is shown in FIG. 4B. A number of potential paths through the graph are illustrated by the different dotted lines connecting the candidate units. A search algorithm may be used to determine potential paths through the graph. Each path may be given a score incorporating both how well the candidate units match the target units (with a high score representing a low target cost of the candidate units) and how well the candidate units concatenate together in an eventual synthesized sequence (with a high score representing a low join cost of those respective candidate units). The unit selection engine 230 may select the sequence that has the lowest overall cost (represented by a combination of target costs and join costs) or may choose a sequence based on customized functions for target cost, join cost or other factors. The candidate units along the selected path through the graph may then be combined together to form an output audio waveform representing the speech of the input text. For example, in FIG. 4B the selected path is represented by the solid line. Thus units $\#_2$, $H_1$, $E_4$, $L_3$, $O_3$, and $\#_4$ may be selected to synthesize audio for the word "hello."

Audio waveforms including the speech output from the TTS module 214 may be sent to an audio output device 204 for playback to a user or may be sent to the output device 207 for transmission to another device, such as another TTS device 202, for further processing or output to a user. Audio waveforms including the speech may be sent in a number of different formats such as a series of feature vectors, uncompressed audio data, or compressed audio data.

Other information may also be stored in the TTS storage 220 for use in speech recognition. The contents of the TTS storage 220 may be prepared for general TTS use or may be customized to include sounds and words that are likely to be used in a particular application. For example, for TTS processing by a global positioning system (GPS) device, the TTS storage 220 may include customized speech specific to location and navigation. In certain instances the TTS storage 220 may be customized for an individual user based on his/her individualized desired speech output. For example a user may prefer a speech output voice to be a specific gender, have a specific accent, speak at a specific speed, have a distinct emotive quality (e.g., a happy voice), or other customizable characteristic. The speech synthesis engine 218 may include specialized databases or models to account for such user preferences. A TTS device 202 may also be configured to perform TTS processing in multiple languages. For each language, the TTS module 214 may include specially configured data, instructions and/or components to synthesize speech in the desired language(s). To improve performance, the TTS module 214 may revise/update the contents of the TTS storage 220 based on feedback of the results of TTS processing, thus enabling the TTS module 214 to improve speech recognition beyond the capabilities provided in the training corpus.

Figure 5:
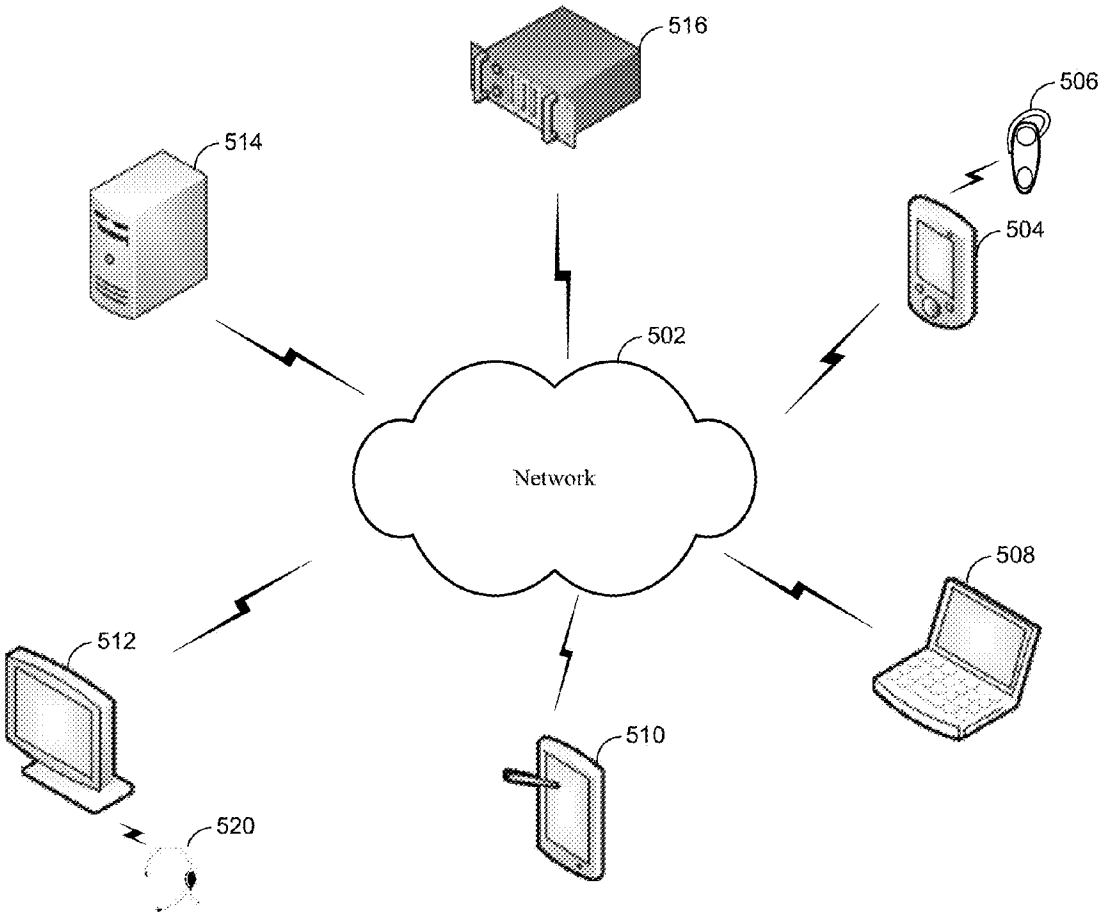
FIG. 5 illustrates a computer network for use with text-to-speech processing according to one aspect of the present disclosure.

Multiple TTS devices 202 may be connected over a network. As shown in FIG. 5 multiple devices may be connected over network 502. Network 502 may include a local or private network or may include a wide network such as the internet. Devices may be connected to the network 502 through either wired or wireless connections. For example, a wireless device 504 may be connected to the network 502 through a wireless service provider. Other devices, such as computer 512, may connect to the network 502 through a wired connection. Other devices, such as laptop 508 or tablet computer 510 may be capable of connection to the network 502 using various connection methods including through a wireless service provider, over a WiFi connection, or the like. Networked devices may output synthesized speech through a number of audio output devices including through headsets 506 or 520. Audio output devices may be connected to networked devices either through a wired or wireless connection. Networked devices may also include embedded audio output devices, such as an internal speaker in laptop 508, wireless device 504 or table computer 510.

In certain TTS system configurations, a combination of devices may be used. For example, one device may receive text, another device may process text into speech, and still another device may output the speech to a user. For example, text may be received by a wireless device 504 and sent to a computer 514 or server 516 for TTS processing. The resulting speech audio data may be returned to the wireless device 504 for output through headset 506. Or computer 512 may partially process the text before sending it over the network 502. Because TTS processing may involve significant computational resources, in terms of both storage and processing power, such split configurations may be employed where the device receiving the text/outputting the processed speech may have lower processing capabilities than a remote device and higher quality TTS results are desired. The TTS processing may thus occur remotely with the synthesized speech results sent to another device for playback near a user.

In such a distributed TTS system, requests from multiple users operating multiple local devices may all go to a single remote TTS device or TTS server, which may be an instance of TTS device 202. If a remote TTS device receives a large number of TTS requests during a certain window of time resulting in a high load on the remote TTS device, the remote TTS device may have difficulty processing all the TTS requests without resulting in delays returning results to the various users. It may be more desirable to reduce the quality of TTS results rather than cause such delays. To that end, the remote TTS device may be adjustable and capable of reconfiguring its TTS processing configurations based on the size of its load/number of TTS requests submitted for processing.

In one aspect, a remote TTS device may be configured with a TTS load balancing module 222 as shown in FIG. 2. The load balancing module 222 may track incoming TTS requests as well as estimated time for completing new incoming TTS requests and existing TTS requests. The TTS load balancing module 222 may be configured to measure the load for a single TTS processing device or for multiple TTS processing devices (such as multiple remote TTS servers) which may be grouped as parts of a TTS system, cluster or other grouping. The TTS load balancing module 222 may be configured to route TTS requests to a TTS device within a group that has a lowest active load, thereby balancing the load of active requests among TTS processing devices in a group or system. If a load on a particular TTS device becomes too high, or the load across multiple devices becomes too high, the TTS load balancing module 222 may indicate to the TTS module(s) 214 of one or more TTS processing devices to activate processing time reducing techniques (such as those discussed below).

The TTS load balancing module 222 may determine whether a load is too high based on the processing capability of the TTS device(s) monitored by the TTS load balancing module 222, as well as the number of in progress and incoming TTS requests and whether the amount of time such requests are estimated to take exceeds a configurable threshold. For example, if new incoming requests are estimated to take more than a certain threshold of time prior to TTS results becoming available to a user, the TTS load balancing module 222 may indicate to one or more TTS processing devices to speed up TTS processing so as to provide at least initial TTS results to a user faster than currently estimated. The TTS load balancing module 222 may estimate the time it may take to process an incoming TTS request based on the server load as well as factors corresponding to the incoming request itself, including the amount of text to be processed, the complexity of the request, etc. Based on the estimate, if the time to complete the request exceeds a threshold, the TTS load balancing module 222 may adjust TTS processing parameters as described below to speed processing and/or reduce the server load. When the processing load of the TTS device(s) returns to normal levels, the TTS load balancing module 222 may indicate to a TTS module 214 to readjust and resume normal processing. Server load may be calculated in a number of ways including the portion of CPU processing being used at any particular time (or an average over a certain time), average time for completion of TTS requests in progress, etc.

The TTS load balancing module 222 may be incorporated into a remote TTS device, such as a TTS server, which processes TTS requests. Or the TTS load balancing module 222 may be part of a separate device which manages TTS tasks for one or more TTS devices. In addition to performing load balancing tasks, the TTS load balancing module 222 may be configured to receive and manage TTS tasks as well as pass notifications between TTS devices (such as remote devices and local devices), authorize or reject TTS tasks, and other higher level functions. For example, in one aspect, the TTS load balancing module 222 may determine that additional processing resources should be allocated to TTS processing during high load times and may submit a request for additional resources to an appropriate scheduling mechanism. In one aspect, if speed improving adjustments are called for, the TTS load balancing module 222 may determine what adjustments to apply and the parameters/configuration for those adjustments.

To speed up TTS processing, a TTS module 214 may adjust certain aspects of TTS processing that may speed the synthesis of speech from text, though may also result in a lower quality TTS output. Such speed-versus-quality tradeoffs may be made when a TTS processing device is faced with a high load, and completing TTS tasks in time may become more important than achieving high quality results. Parameters such as unit selection parameters or audio generation parameters may be adjusted to improve the speed of TTS performance. Unit selection parameters may include such parameters as the size of a unit database, the width of a Viterbi beam search, the size of a unit graph, or other unit selection parameters. Audio generation parameters may include such parameters as the speed/quality of decoding of unit audio samples, the speed/quality of unit concatenation, the speed/quality of signal processing, e.g., changing the sampling rate, duration, pitch, etc. of output speech. The unit selection parameters and audio generation parameters may together be called TTS processing parameters. Adjustment of the TTS processing parameters may be done adaptively in response to a changing load of a TTS system or different potential settings for these parameters may be preselected and chosen based on the load of a TTS system. For example, the size of a unit database, Viterbi beam width and/or unit graph may get reduced as load increases. Similarly, the speed of decoding of unit audio samples, unit concatenation may increase as the load increases.

In one aspect, a unit selection engine 230 may use a smaller unit database with a smaller number of speech units from which to select units for concatenation and speech synthesis. By using a smaller unit database, the unit selection engine 230 reduces the amount of processing time selecting which units from among the available stored candidate units may correspond to target units of the text to be synthesized. In this manner the speed of TTS processing may be increased. Use of a smaller unit database may, however, result in lower quality TTS results as certain units which may be available in the larger unit database (and may have lower target costs in certain circumstances) will be unavailable in the smaller unit database which may lead to lower quality of synthesized speech.

In one aspect, the smaller unit database may be pre-configured and available in the TTS storage 220 to be used whenever a high load is indicated, such as by the TTS load balancing module 222. In another aspect, a smaller unit database may be dynamically configured by removing certain units from a larger unit database. The size of the smaller unit database may be adjustable based on the size of the load on the TTS device. For example, in the dynamic aspect the number of units removed from the unit database may depend on how much of a speed improvement is desired from the TTS device. Similarly, multiple smaller unit databases may be pre-configured with the particular reduced size unit database chosen based on a desired level of processing speed improvement. The smaller unit databases may be configured to include the most frequently used units or units expected to be used in certain circumstances (such as for specific tasks, specific users, domains, etc.). In another aspect, instead of dynamically creating a separate unit database, the unit selection engine 230 may be configured to consider only certain units in the standard unit database for TTS processing, thus effectively limiting the size of the unit database for purposes of reducing TTS processing time.

In another aspect, the selection of potential units during the Viterbi search may be limited by a Viterbi beam search to reduce the number of candidate units and increase processing time. In a heuristic Viterbi beam width, the Viterbi algorithm used to determine the most likely path through the graph depicted in FIG. 4B may be adjusted so that only potential paths through the graph that are above a certain score (or below a certain cost) are considered by the Viterbi algorithm, and paths that are beyond the desired score (or cost) are eliminated as potential paths. The range of potential path scores to remain under consideration is the "width" of the Viterbi beam. The width of the beam may be fixed or variable and may depend on the desired speed increases for the TTS processing device. During activation of the Viterbi beam search the unit selection engine 230 will discard any potential units that fall outside the width of the Viterbi beam. By discarding those units, the unit selection engine 230 will complete its processing faster, but may discard units that would have resulted in higher quality speech synthesis. The Viterbi beam search settings may be determined ahead of time and selected based on the actual or predicted server load or may be determined dynamically based on the server load.

In another aspect, the graph for unit selection may be partitioned, thus resulting in only a portion of a graph to be used for processing, resulting in fewer calculations by the unit selection engine 230 in navigating the graph to select from among the candidate units. The partitioned candidate unit graph may be determined in advance based on different levels of potential server load/number of in progress TTS requests. Multiple partitioned graph sizes may be available for the unit selection engine 230 to choose among based on the server load. In another aspect, rather than being chosen from among sizes determined in advance, the graph size may be adjusted dynamically based on the actual or predicted server load. The graph size may be determined prior to execution of the Viterbi algorithm for navigating the graph. The partitioned graph size limits the complexity of the unit selection, thus increasing processing speed and decreasing processing time. The smaller graph size may, however, result in lower quality results as there are fewer candidate units available to the unit selection engine 230 for eventual concatenation and speech synthesis.

In another aspect, audio generation parameters may be adjusted based on a load of the TTS system. For example, unit audio samples stored in a unit database are typically encoded (i.e., compressed). To decrease TTS load, the speed of decoding these unit audio samples may be increased. Although such a speed increase may decrease the quality of the audio signal and thus the ultimate quality of synthesized speech using the decoded samples, such a configuration may reduce TTS system load more quickly. Similarly, the TTS system may be configured to concatenate unit samples more quickly (in a unit selection speech synthesis operation), or to generate parametric speech more quickly (in a parametric speech synthesis operation). Such a speed increase may also result in a reduced quality, but may be determined to be desirable to reduce TTS system load. Similarly, the TTS system may lower a signal resampling quality to increase processing speed.

The steps to decrease TTS processing time may be executed based on an actual server load or may be based on a predicted server load as determined by the TTS load balancing module 222. Server load may be predicted based on previous TTS activity (for example, if a high number of requests are expected during particular times of day, days of the week, etc.) or other predictive techniques. In one aspect, server load may be predicted based on a rate of incoming new requests to a TTS server(s). If the number of incoming requests begins to spike, a TTS load balancing module 222 may determine that speed improving techniques should be implemented preemptively to avoid delays in processing incoming TTS requests.

Such preemptive techniques may be applied only to new TTS requests as opposed to TTS requests that are already being processed by the system. One reason to not apply speed improving techniques to requests that are already in progress is the potential drop in quality that may be experienced by implementing such speed improving techniques. It may be undesirable to change a quality of TTS processing of a request during processing as such change in quality may be jarring to a user and result in dissatisfaction. For many users experiencing a drop in speech synthesis quality during a particular request is more undesirable than simply experiencing a lower quality speech synthesis over an entire request. Thus, in one aspect, the techniques described herein to improve the speed of TTS processing may be applied only to new incoming TTS requests as opposed to TTS requests which are in processing at the time the server load becomes high. In this aspect the techniques described herein may be applied to shorter, rather than longer, TTS requests to avoid changing TTS quality mid-request. In another aspect, if a smaller number of longer TTS requests are consuming significant server resources, and lowering the quality of those requests may result in a significant reduction in processing time for a large number of other requests, then the system may adjust the quality of those high resource requests, even if the server has already begun TTS processing on those requests.

In another aspect, TTS requests may be prioritized based on which requests should be processed with lower speed (and resulting potential higher quality) and which requests should be processed with higher speed (but potential lower quality). Factors to be considered may include whether a TTS request is already being processed, how far along the request is, the user settings of the request (for example whether a user has indicated a preference for high quality results or rapid turnaround time), the price a user has paid for processing of his/her request, the source of the request (for example the identity of the user or whether the request originates at a corporate entity), the ease of processing of the request, or the like.

In another aspect, if there are a large number of TTS requests in progress at the time a server load passes a threshold beyond which speed improvements may be called for, the TTS load balancing module 222 may determine whether one or more TTS requests already in progress should be restarted using the speed improvements. Such a determination may be made based on whether restarting TTS request(s) may result in providing results to a user faster, both for such individual requests and for other requests which are contributing to the server load. Time for completion of TTS processing may be based on a number of factors including input text length for each request, available server processing, whether portions of TTS processing may be offloaded (such as to a local device as described below), etc. In another aspect, the system may return a request to a user with an indication of the high server load and may present the user with the option of selecting lower quality TTS processing or resubmission of the TTS request at a later time. The TTS load balancing module 222 may also reject certain incoming TTS requests if called for by the high server load.

In another aspect, the adjustments to TTS processing to increase speed may be configured differently for different TTS requests based on the number of TTS requests in progress that are above the high server threshold load. For example, for a first number of initial TTS requests above the chosen threshold, a first set of speed improvements and configuration resulting in certain speed gains and quality losses may apply. For a second number of TTS requests following that initial number, a second set of speed improvements and configuration resulting in different speed gains and quality losses may apply. For example, for the first set of TTS requests a particular first reduced size of unit database and first width Viterbi beam search may be implemented. For a second set of TTS requests, a second reduced size of unit database and second width Viterbi beam search may be implemented, where the second configuration results in higher speed gains (but lower quality results) than the first set. Such a difference may be implemented to counter a growing server load/backlog. Subsequent sets from the second may experience even further speed improvements (or quality reductions) based on the server load of requests in progress or pending.

In one aspect, the techniques described may be combined with other techniques of distributed TTS processing, specifically TTS processing by a local device. If a high load is indicated or predicted on remote TTS servers, the TTS system may be configured to allow local devices to perform some TTS processing to speed up the delivery of at least initial TTS results to users. After beginning processing on a local device, a TTS request may be completed by the local device or may be passed off to a remote device if load levels on the remote device come down, if the remote device can continue the processing without significantly delaying completion of the request, or for other reasons. In another aspect a remote TTS device may begin the TTS processing and the local TTS device may complete the TTS processing. Other divisions of processing are also possible. One method of performing distributed TTS processing on a local device is described in U.S. patent application Ser. No. 13/740,762, filed Jan. 14, 2013, entitled "DISTRIBUTED SPEECH UNIT INVENTORY FOR TTS SYSTEMS" in the names of Osowski, et al., which is hereby incorporated by reference in its entirety.

Figure 6A:
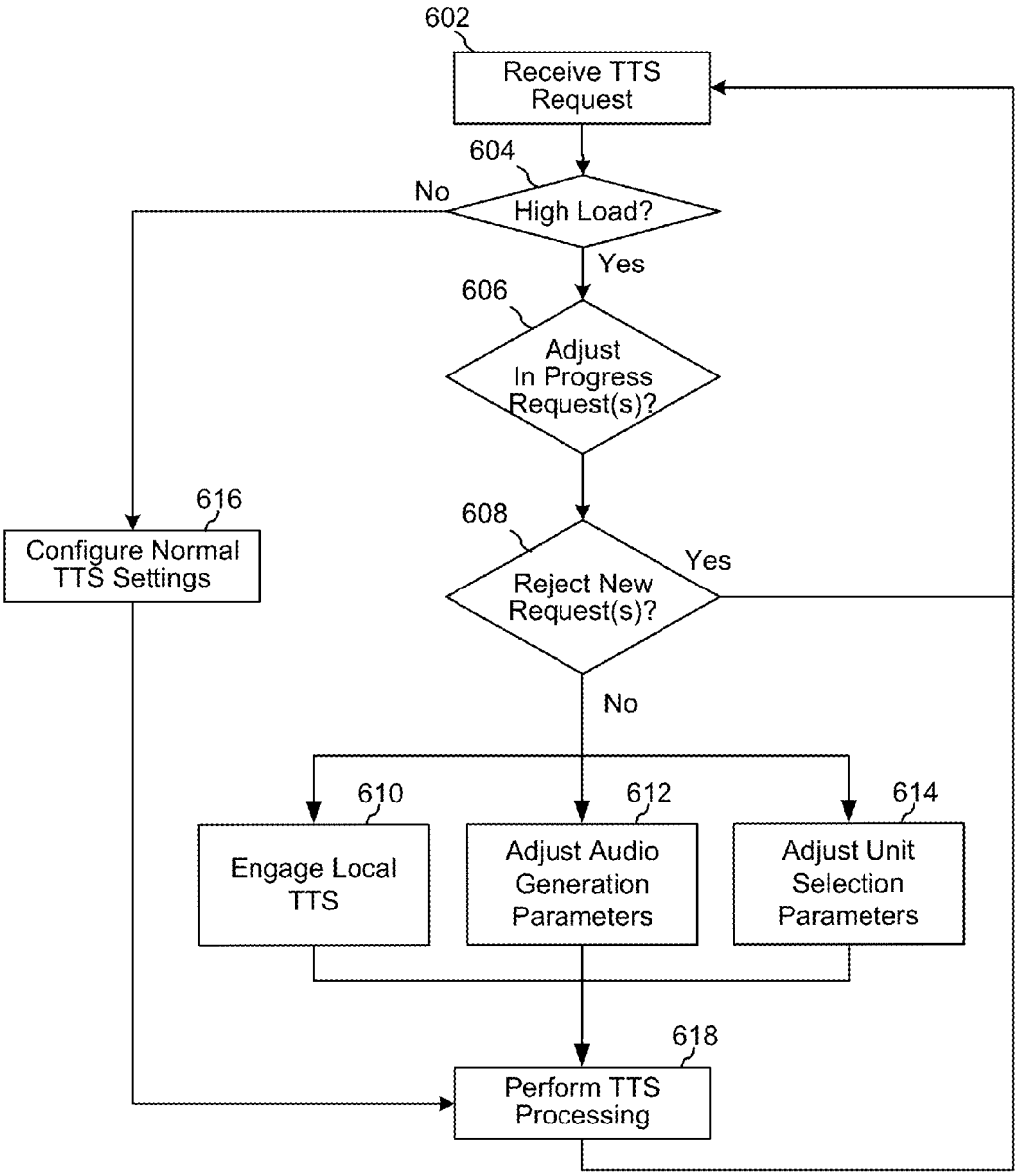
FIG. 6A illustrates adjustable TTS processing according to one aspect of the present disclosure.
Figure 6B:
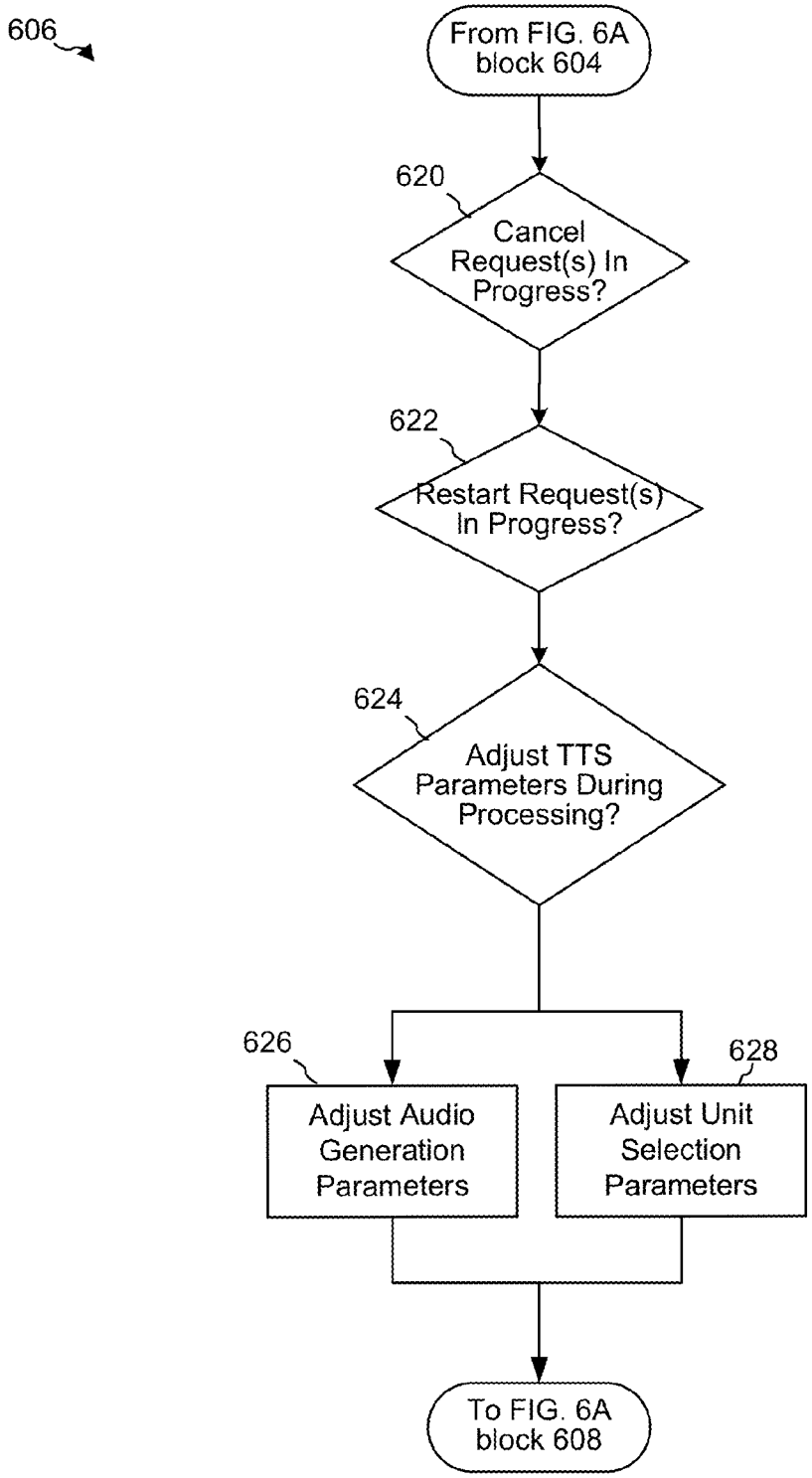
FIG. 6B illustrates adjustable TTS processing according to one aspect of the present disclosure.

In one aspect of the present disclosure, TTS processing may be adjusted as illustrated in FIG. 6A. TTS requests are received 602 and a determination is made 604 as to whether a high load is experienced or predicted. If no high load is determined, the system configures normal TTS settings 616 and performs TTS processing 618. If a high load is determined, the system determines 606 whether to adjust TTS requests already in progress. A further explanation of adjusting TTS requests in progress is illustrated in FIG. 6B. The TTS system also determines 608 whether to reject new TTS requests. If TTS requests are rejected, the system continues to receive and process new TTS requests 602 and check for a high load 604. The system may also determine for new TTS requests whether to engage local TTS processing 610, whether to adjust audio generation parameters 612, and/or whether to adjust unit selection parameters 614, as detailed above. Based on selection of one or more of the load reducing techniques, the system performs TTS processing 618 and continues to receive new TTS requests 602. The tests and load reducing techniques illustrated in FIG. 6A may occur in order as illustrated, generally in parallel, or in any different configuration.

FIG. 6B illustrates the detailed check of whether to adjust TTS requests in progress 606. The TTS system checks whether the load on the TTS system is so heavy that one or more TTS requests in progress should be cancelled 620. The TTS system also checks whether one or more TTS requests in progress should be stopped and restarted using adjusted TTS parameters 622. The system also checks whether one or more TTS requests in progress should continue to be processed with adjusted TTS parameters. If adjusted TTS parameters should be applied to in progress TTS requests (whether those adjusted parameters are applied to restarted requests or to requests as they are in progress), the system may adjust audio generation parameters 626 and/or adjust unit selection parameters 628. The tests and load reducing techniques illustrated in FIG. 6B may also occur in order as illustrated, generally in parallel, or in any different configuration.

The above aspects of the present disclosure are meant to be illustrative. They were chosen to explain the principles and application of the disclosure and are not intended to be exhaustive or to limit the disclosure. Many modifications and variations of the disclosed aspects may be apparent to those of skill in the art. For example, the TTS techniques described herein may be applied to many different languages, based on the language information stored in the TTS storage.

Aspects of the present disclosure may be implemented as a computer implemented method, a system, or as an article of manufacture such as a memory device or non-transitory computer readable storage medium. The computer readable storage medium may be readable by a computer and may comprise instructions for causing a computer or other device to perform processes described in the present disclosure. The computer readable storage medium may be implemented by a volatile computer memory, non-volatile computer memory, hard drive, solid state memory, flash drive, removable disk, and/or other media.

Aspects of the present disclosure may be performed in different forms of software, firmware, and/or hardware. Further, the teachings of the disclosure may be performed by an application specific integrated circuit (ASIC), field programmable gate array (FPGA), or other component, for example.

Aspects of the present disclosure may be performed on a single device or may be performed on multiple devices. For example, program modules including one or more components described herein may be located in different devices and may each perform one or more aspects of the present disclosure. As used in this disclosure, the term "a" or "one" may include one or more items unless specifically stated otherwise. Further, the phrase "based on" is intended to mean "based at least in part on" unless specifically stated otherwise.

What is claimed is:

1. A computing device, comprising:

at least one processor;

memory including instructions that, when executed, configure the at least one processor:

to determine a load of a server processing TTS requests;

to receive text data for TTS processing;

to estimate a time of completion for the TTS processing of the text data based at least in part on the determined load;

to determine that the time of completion is greater than a threshold time;

to adjust at least one TTS processing parameter from a first value to a second value based at least in part on the time of completion, wherein the at least one TTS parameter includes a unit database size, a Viterbi beam width, a candidate unit graph size, or an audio sampling rate;

to synthesize speech based on the text data using the second value; and to transmit audio data comprising the synthesized speech for playback to a user.

2. The computing device of claim 1, wherein the at least one processor is further configured to determine the second value based at least in part on the load.

3. The computing device of claim 1, wherein the at least one processor is further configured to adjust the at least one TTS processing parameter by selecting the unit database size from a plurality of pre-determined unit database sizes.

4. The computing device of claim 1, wherein the at least one processor is further configured:

to receive second text data for TTS processing;

to synthesize a first portion of the second text data using the first value; and to synthesize a second portion of the second text data using the second value.

5. A method comprising:

receiving, by a server, a text-to-speech (TTS) processing request from a local device;

determining, by the server, a number of pending TTS processing requests of a TTS processing device of the server;

estimating a time of completion for the TTS processing request based on the number of pending TTS processing requests;

determining the time of completion is greater than a threshold time;

setting, by the server, a TTS processing parameter to a first value based at least in part on the time of completion being greater than the threshold time, the TTS processing parameter adjusting TTS quality output of the TTS processing device;

processing, by the TTS processing device, the TTS processing request using the first value; and transmitting, by the server, results of the processing to the local device.

6. The method of claim 5, wherein the first value comprises one or more of a unit database size, a Viterbi beam width, a candidate unit graph size, or an audio sampling rate.

7. The method of claim 6, further comprising selecting the unit database size from a plurality of pre-determined unit database sizes.

8. The method of claim 5, further comprising:

comparing the number of pending TTS requests to a threshold; and setting the TTS processing parameter to the first value based at least in part on the comparing.

9. The method of claim 5, further comprising:

receiving a second TTS processing request;

synthesizing a first portion of the second TTS processing request using a second value for the TTS processing parameter; and synthesizing a second portion of the second TTS processing request using the first value.

10. The method of claim 5, further comprising:

receiving a second TTS processing request;

synthesizing a first portion of the second TTS processing request using a second value for the TTS processing parameter;

restarting synthesis of the second TTS processing request; and synthesizing the second TTS processing request using the first value.

11. The method of claim 5, further comprising predicting a future number of TTS processing requests of the TTS processing device, and wherein setting the TTS processing parameter to the first value is further based at least in part on the future number of TTS processing requests.

12. The method of claim 5, further comprising instructing a second local device to perform TTS processing on a second TTS processing request based at least in part on the number of pending TTS processing requests.

13. A computing system, comprising:

at least one processor;

memory including instructions that, when executed, configure the at least one processor to:

receive, by a server, a text-to-speech (TTS) processing request from a local device;

determine, by the server, a number of pending TTS processing requests of a TTS processing device of the server;

estimate a time of completion for the TTS processing request based on the number of pending TTS processing requests;

determine the time of completion is greater than a threshold time;

set, by the server, a TTS processing parameter to a first value based at least in part on the time of completion being greater than the threshold time, the TTS processing parameter adjusting TTS quality output of the TTS processing device;

process, by the TTS processing device, the TTS processing request using the first value; and transmit, by the server, results of the processing to the local device.

14. The computing system of claim 13, wherein the first value comprises one or more of a unit database size, a Viterbi beam width, a candidate unit graph size, or an audio sampling rate.

15. The computing system of claim 14, wherein the instructions further configure the at least one processor to select the unit database size from a plurality of pre-determined unit database sizes.

16. The computing system of claim 13, wherein the instructions further configure the at least one processor to:

compare the number of pending TTS requests to a threshold; and set the TTS processing parameter to the first value based at least in part on the comparing.

17. The computing system of claim 13, wherein the instructions further configure the at least one processor to:

receive a second TTS processing request;

synthesize a first portion of the second TTS processing request using a second value for the TTS processing parameter; and synthesize a second portion of the second TTS processing request using the first value.

18. The computing system of claim 13, wherein the instructions further configure the at least one processor to:

receive a second TTS processing request;

synthesize a first portion of the second TTS processing request using a second value for the TTS processing parameter;

restart synthesis of the second TTS processing request; and synthesize the second TTS processing request using the first value.

19. The computing system of claim 13, wherein the instructions further configure the at least one processor to:

predict a future number of TTS processing requests of the TTS processing device, wherein the instructions configuring the at least one processor to set the TTS processing parameter to the first value further include instructions to set the TTS processing parameter to the first value based at least in part on the future number of TTS processing requests.

20. The computing system of claim 13, wherein the instructions further configure the at least one processor to instruct a second local device to perform TTS processing on a second TTS processing request based at least in part on the number of pending TTS processing requests.

* * * * *